US006695410B2

(12) United States Patent
Hsia

(10) Patent No.: US 6,695,410 B2
(45) Date of Patent: Feb. 24, 2004

(54) ADJUSTABLE SUPPORT SYSTEM OF SEAT STRUCTURE

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 23 days.

(21) Appl. No.: 09/864,573

(22) Filed: May 23, 2001

(65) Prior Publication Data

US 2002/0175551 A1 Nov. 28, 2002

(51) Int. Cl.[7] ..... A47C 7/02
(52) U.S. Cl. ..... 297/452.4; 297/380; 297/284.3
(58) Field of Search ..... 297/380, 382, 297/452.4, 452.33, 452.34, 284.3, 284.9

(56) References Cited

U.S. PATENT DOCUMENTS 1,508,859 A * 9/1924 Schoenhoff
2,107,880 A * 2/1938 Wilsdorf
2,607,400 A * 8/1952 Witz
4,824,171 A * 4/1989 Hollingsworth
5,938,284 A * 8/1999 Coffield
6,007,572 A * 12/1999 Baldwin
6,012,769 A * 1/2000 Hsueh et al.

* cited by examiner

*Primary Examiner*—Milton Nelson, Jr.
(74) *Attorney, Agent, or Firm*—Raymond Y. Chan; David and Raymond Patent Group

(57) ABSTRACT

An adjustable support system of seat structure includes two side supporting units foldably extended from two vertical sides of the back panel, at least an elongated element having a predetermined length of holding portion extended from the back panel through the two side supporting units respectively, and an adjustable locker securely locked up two free end portions of the elongated element for adjusting the length of the holding portion of the elongated element, so as to adjust a folding angle between each of the side supporting units and the back panel.

15 Claims, 5 Drawing Sheets

ADJUSTABLE SUPPORT SYSTEM OF SEAT STRUCTURE

BACKGROUND OF THE PRESENT INVENTION

1. Field of Invention

The present invention relates to a seat structure, and more particularly to an adjustable support system of seat structure which can selectively adjust the shape of the seat structure to well support a user such that the user is capable of lying on the seat structure naturally and comfortably, especially when the user is a baby or a young child with a soft and weak neck.

2. Description of Related Arts

A conventional seat structure for supporting a user sitting thereon comprises a seat frame and a back frame extended from the seat frame in an upright manner. However, since the user is forced to sit upright on the seat structure, he or she may feel uncomfortable. Even though the seat structure can provide an inclined back frame that enables the user to inclinedly lay his or her back thereon comfortably, he or her has an intention to slide out the seat frame frontwardly. Thus, the user tends to slide his or her back sidewardly on the back frame especially when he or her is driving.

An improved seat structure further comprises a thigh support and two side supports wherein the thigh support is provided on the seat frame for substantially supporting the user's tight so as to prevent the user sliding out of the seat frame frontwardly. The two side supports frontwardly extended from two sides of the back frame for substantially supporting the user's back so as to prevent the user sliding on the back frame sidewardly. However, such improved seat structure fails to well support the user to sit thereon.

Due to the different sizes of the user's body, such improved seat structure may not totally fit for all users. However, it is impossible to tailor make each seat structure for an individual so that the user has no personal choose for other more comfortable seat structure according to he or her own size.

Moreover, the major drawback of the seat structure is that when the seat structure is incorporated with car seat of a stroller or a vehicle, it cannot well support the movement of the user. Commonly, the user may merely sleep on the car seat of the stroller or the vehicle during a distance travel. When the user is sleeping, his or her weak neck tends to bend to drop down his or her head such that the movement of the vehicle will force the user's head to shake, which will hurt the user's neck. So, the user always gets pain on his or her neck after sleeping in the moving vehicle. However, if the user is an infant whose has soft and weak neck may be permanently and seriously hurt because of not having properly supported during the movement of the vehicle.

SUMMARY OF THE PRESENT INVENTION

A main object of the present invention is to provide an adjustable support system of a seat structure which can selectively adjust the shape of the seat structure to well support a user's back such that the user is capable of lying on the seat structure naturally and comfortably.

Another object of the present invention is to provide an adjustable support system of a seat structure, wherein the user can adjust the supporting area of the seat structure to fittingly supporting the user.

Another object of the present invention is to provide an adjustable support system of a seat structure, wherein the back panel can be quickly and easily adjusted its inclined angle with respect to the seat panel.

Another object of the present invention is to provide an adjustable support system of a seat structure which substantially increases the supporting area of the seat structure to more evenly distribute and support the downwardly pulling force by the user's weight.

Another object of the present invention is to provide an adjustable support system of a seat structure wherein the user's head is well supported by two upper portions of two side extensions, so as to prevent an unwanted movement of the user's head especially when he or her is sleeping on a moving vehicle.

Another object of the present invention is to provide an adjustable support system of a seat structure, wherein the user's thigh can also be adjustably supported on the seat structure. In other words, the seat structure incorporated with the adjustable support system is more comfortable and capable of well supporting the user's weight in comparison with the conventional seat structure.

Another object of the present invention is to provide an adjustable support system of a seat structure, wherein no expensive or complicate mechanical structure is required to employ in the present invention in order to achieve the above mentioned objects. Therefore, the present invention successfully provides an economic and efficient solution for selectively adjusting the seat back in any inclined angle and providing reinforced back panel configuration for all users.

Accordingly, in order to accomplish the above objects, the present invention provides a seat structure which comprises a seat panel and a back panel foldably extended from the seat panel.

The seat structure further comprises an adjustable support system which comprises two side supporting units foldably extended from two vertical sides of the back panel, at least an elongated element having a predetermined length of holding portion extended from the back panel through the two side supporting units respectively, and an adjustable locker securely locked up two free end portions of the elongated element for adjusting the length of the holding portion of the elongated element, so as to adjust a folding angle between each of the side supporting units and the back panel.

Alternatively, the adjustable support system comprises at least an elongated unit having a predetermined length of controlling portion extended from the back panel to the seat panel and an inclination locker securely locked up two free end portions of the elongated unit for adjusting the length of the controlling portion of the elongated unit, so as to adjust an inclined angle between the back panel and the seat panel.

DETAILED DESCRIPTION OF THE PREFERRED EMBODIMENT

Figure 1:
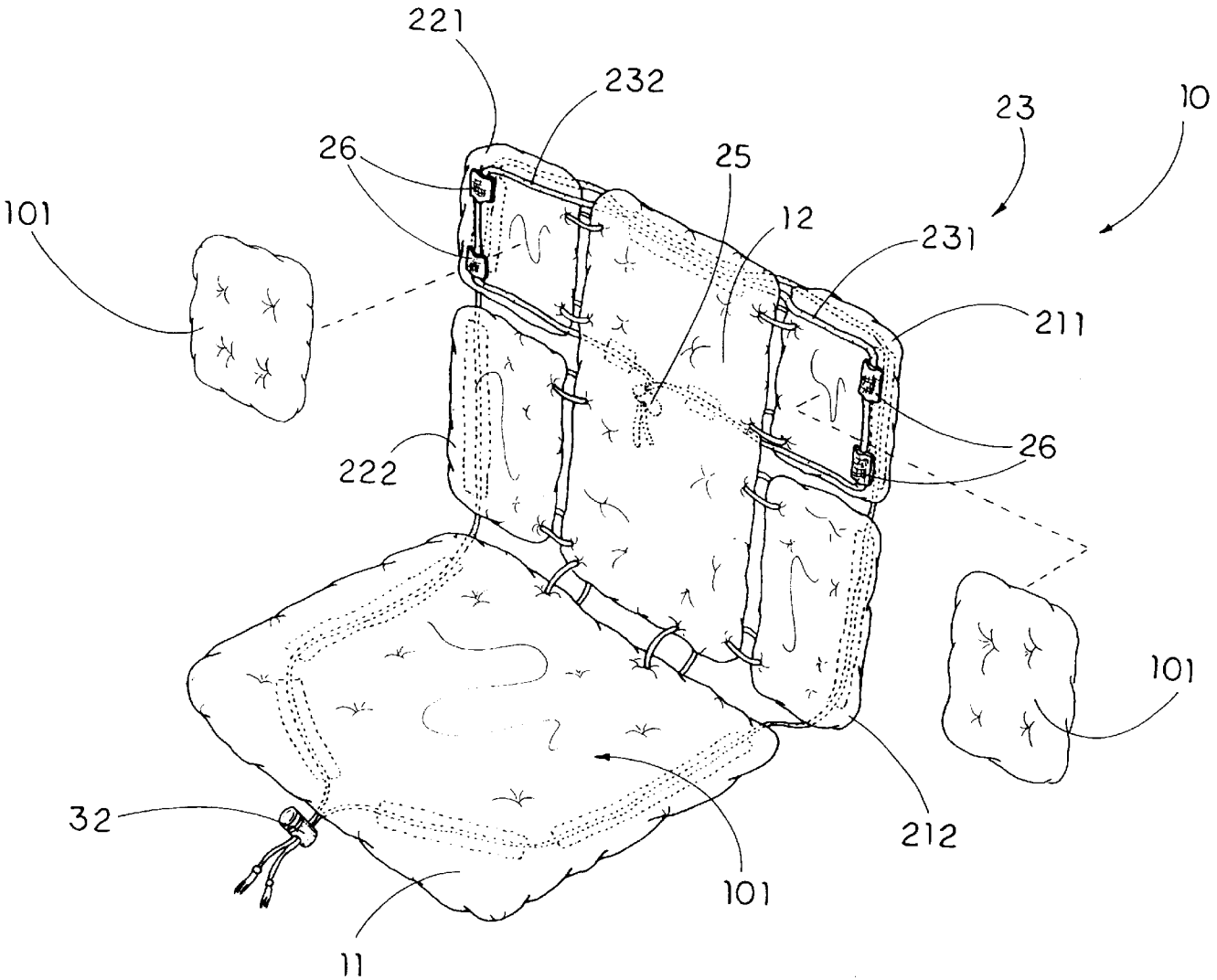
FIG. 1 is a perspective view of the seat structure incorporated with an adjustable support system in an opened position according to a preferred embodiment of the present invention.

Referring to FIG. 1, a seat structure 10 according to a preferred embodiment of the present invention is illustrated, wherein the seat structure 10 comprises a seat panel 11 and a back panel 12 foldably extended from the seat panel 11.

Figure 2:
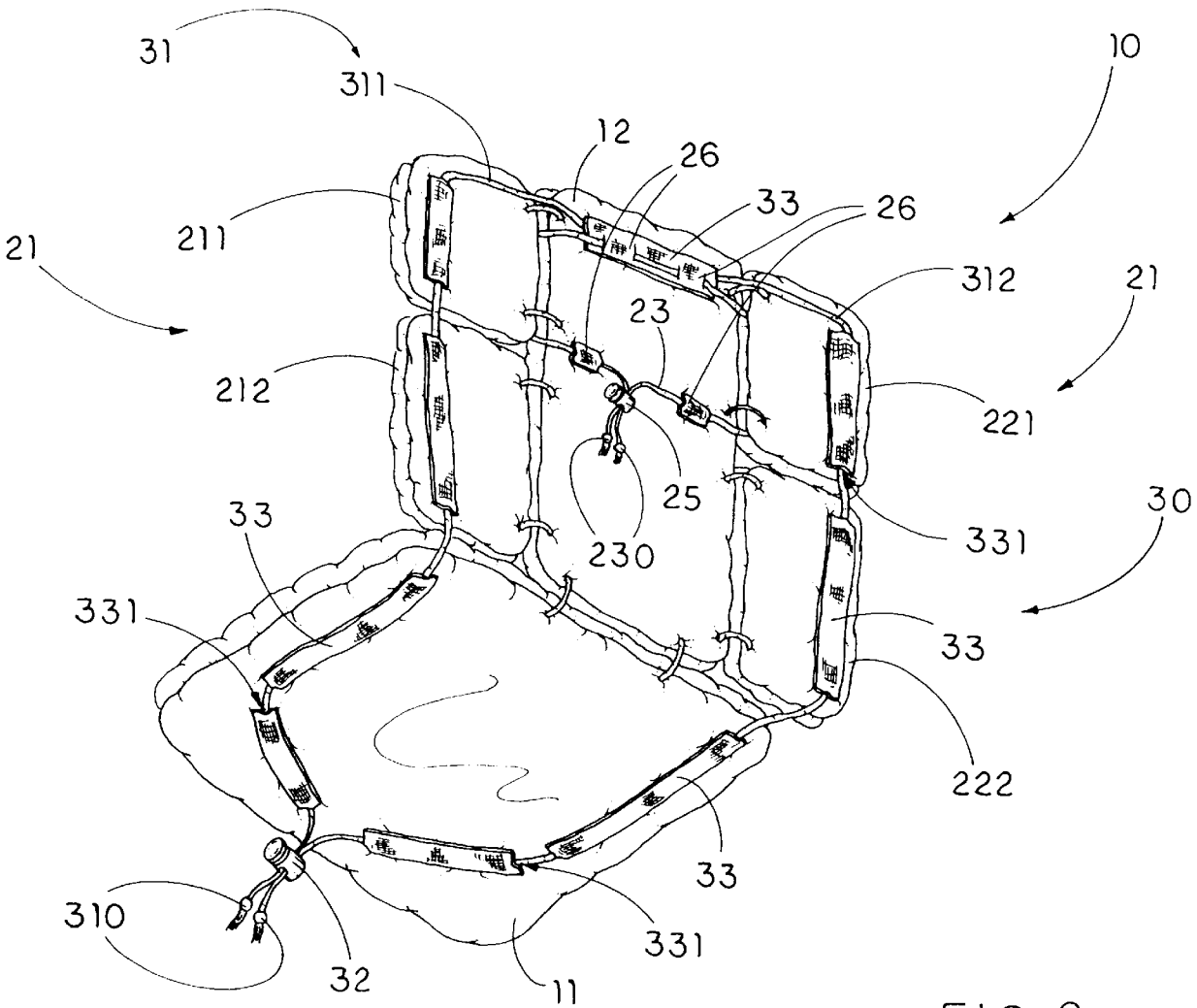
FIG. 2 is a rear perspective view of the seat structure according to the above preferred embodiment of the present invention.

As shown in FIG. 2, the seat structure 10 further comprises an adjustable support system 20 comprising two side supporting units 21, 22 sidewardly and foldably extended from two vertical sides of the back panel 12, at least an elongated element 23 having a predetermined length of holding portion extended from the back panel 12 through the two side supporting units 21, 22 respectively, and an adjustable locker 25 securely locking up two free end portions of the elongated element 23 for adjusting the length of the holding portion of the elongated element 23, so as to adjust a folding angle between each of the side supporting units 21, 22 and the back panel 12.

According to the preferred embodiment, the seat panel 11 is affixed by stitching to the back panel 12 in an edge to edge manner such that the back panel 12 is adapted for folding between an unfolded position and folded position with respect to the seat panel 11. In which, in the unfolded position, the back panel 12 is inclinedly extended from the seat panel 11, and in the folded position, the back panel 12 is overlappedly folded on the seat panel 11. Moreover, at least a cushion pad 101 is provided on the seat structure 10 to better and more comfortably support the user.

The two side supporting units 21, 22, which are two side fabric panels having predetermined widths, are affixed to the two vertical sides of the back panel 12 in an edge to edge manner by stitching. Each of the two side supporting units 21, 22 comprises an upper side support 211, 221 and a lower side support 212, 222 wherein the upper side support 211, 221 and the lower side support 212, 222 are foldably extended from the side of the back panel 12 respectively for individually adjusting the folding angle between each of the upper and lower side supports 211, 212, 221, 222 of the side supporting units 21, 22 and the back panel 12.

The elongated element 23, which is embodied as a durable string having a predetermined length in the present preferred embodiment, has a holding portion extended from the back panel 12 through the two upper side supports 211, 221 of the two side support units 21, 22 and two free ends arranged to adjustably engage with the adjustable locker 25 behind the back frame 12.

Figure 4:
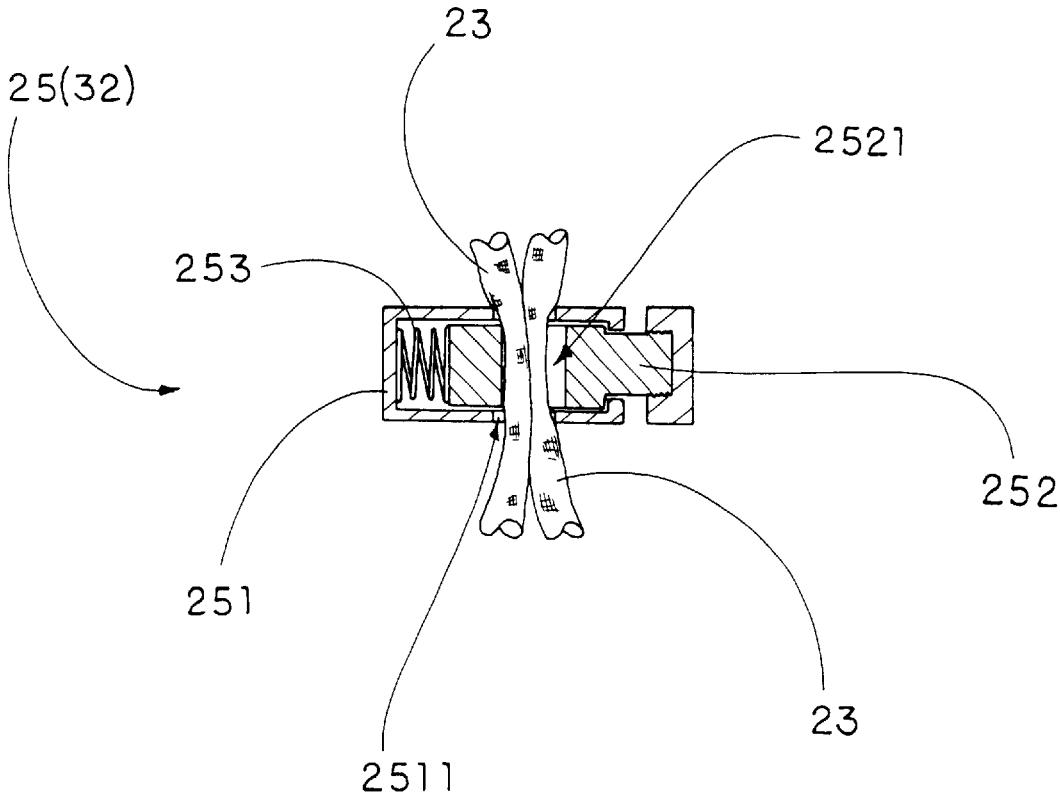
FIG. 4 is a sectional view of an adjustable locker of the seat structure according to the above preferred embodiment of the present invention.

As shown in FIG. 4, the adjustable locker 25 comprises a locker body 251 which is a hollow body having an opened end and a locker hole 2511 radially passing through a central portion thereof, an operation body 252 having an inner end slidably inserted into the locker body 251 through the opened end, and a spring 233 disposed between another closed end of the locker body 251 and the inner end of the operation body 252, wherein the operation body 252 further has a locking hole 2521 radically passing through in such a manner that the locking hole 2521 and the locker hole 2511 are able to be arranged coaxially overlapped with each other when pushing an outer end of the operation body 252 towards the closed end of the locker body 251 so as to enable two free end portions of the elongated element 23 to slidably pass through both the locker hole 2511 and the locking hole 2521. However, the spring 253 normally pushes the operation body 252 towards its opened end and reduces the gap formed between the locking hole 2521 and the locker hole 2511, so that the locker body 251 and the operation body 252 compress the elongated element 23 passing therethrough so as to securely and firmly lock up the position of the adjustable locker 25 with respect to the elongated element 23.

Figure 3:
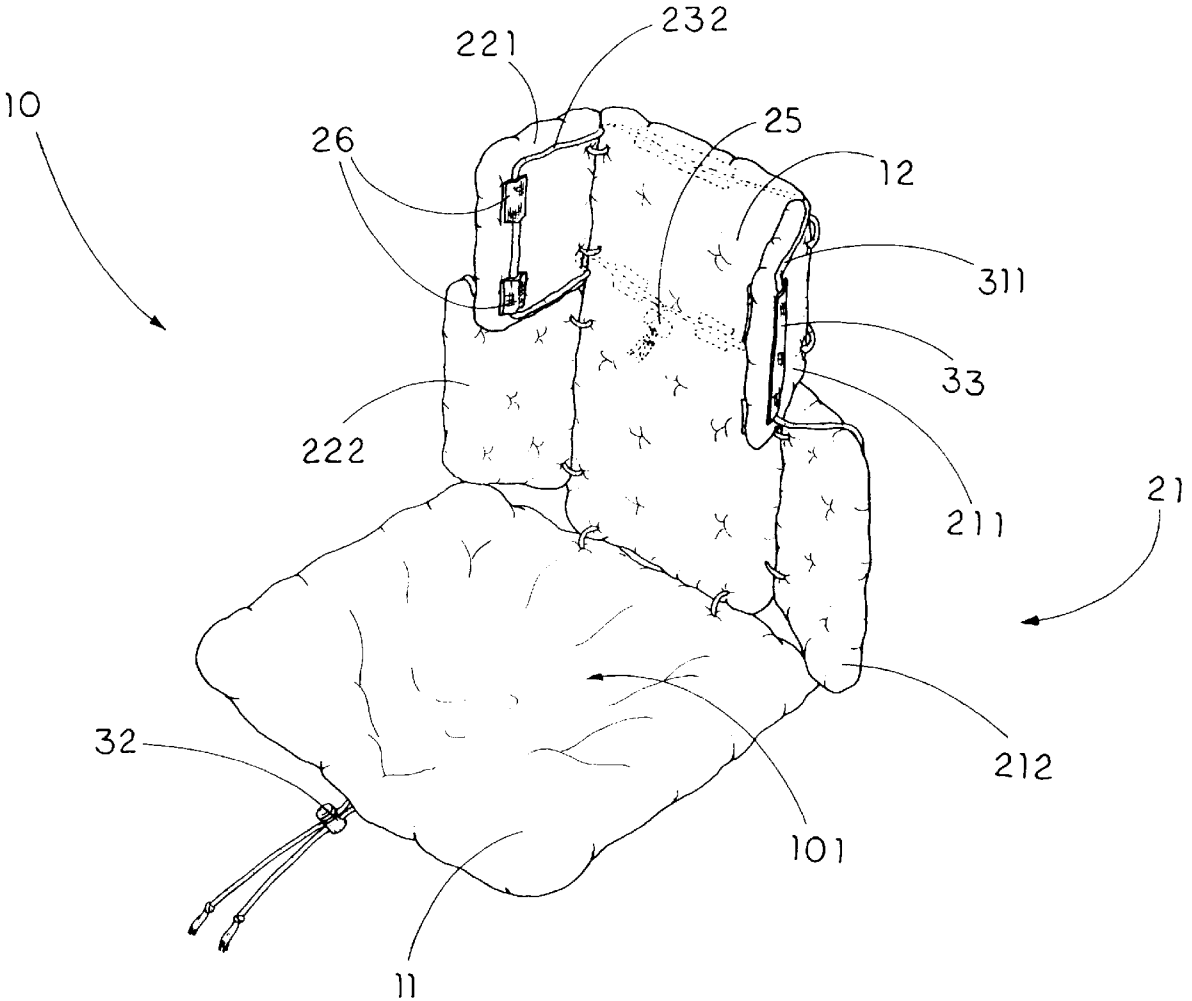
FIG. 3 is a perspective view of two side supporting units of the seat structure in a folded position according to the above preferred embodiment of the present invention.

In other words, by locking the adjustable locker 25 at different positions of the elongated element 23 can substantially adjust a length of the holding portion of the elongated element 23 extended between the adjustable locker 25 and the back panel 12, so as to adjust the folding angle between each of the upper side supports 211, 221 of the side supporting units 21, 22 and the back panel 12, as shown in FIG. 3.

Therefore, the folding angle between each upper side support 211, 221 is reduced when shorten the length of the holding portion of the elongated element 23 between the back panel 12 and the adjustable locker 25, i.e. the two upper side supports 211, 221 tend to fold towards to the back panel 12. The folding angle between each upper side support 211, 221 is increased when lengthen the length of the holding portion of the elongated element 23 between the back panel 12 and the adjustable locker 25, i.e. the two upper side supports 211, 221 tend to unfold with the back panel 12. Therefore, the two upper side support 211, 221 are capable of adjustably supporting the user's head therebetween so as to prevent an unwanted movement of the user's head especially when the user is sleeping in the moving vehicle.

Besides, each of the free ends of the elongated element 23 is firmly tied to form a knot 230 for blocking the elongated element 23 from sliding out of the locker hole 2511, so as to prevent the adjustable locker 25 from being disengaged from the elongated element 23 accidentally during adjusting the position of the adjustable locker 25.

Accordingly, at least a portion of the elongated element 23 can be firmly affixed to the back panel 12 to form two holding sections 231, 232 to adjustably control the folding angles of the two upper side supports 211, 221 respectively. The adjustable locker 25 can securely lock up the free end portion of the respective holding section 231, 232 of the elongated element 23 to adjust a length of a holding portion of the respective holding section 231, 231 of the elongated element 23, so as to independently adjust the folding angle between the respective upper side support 211, 221 and the back panel 12.

In other words, each of the upper side support 211, 221 can be individually controlled by the respective holding section 231, 232 of the elongated element 23 by controlling the length of the holding portion of the respective holding section 231, 232 of the elongated element 23 such that the user is able to select two different folding angles between the two upper side supports 211, 221 and the back panel 12 respectively.

It is worth to mention that two elongated elements 23 which functions as the two holding section 231, 232 can achieve the above feature that each elongated element 23 has a connecting end affixed to the back panel 12 and a free end is arranged to be extended through the respective upper side support 211, 221 and locked up by the adjustable locker 25 behind the back panel 12. So, by varying the length of the holding portion of each elongated element 23 can adjust the folding angle between the respective upper side support 211, 221 and the back panel 12 individually.

The adjustable support system 20 further comprises at least two elongated element guiders 26 for guiding an adjustment of the two elongated elements 23 provided on the two upper side supports 211, 221 respectively wherein the elongated element 23 is extended to pass through the two elongated element guiders 26 respectively so as to support the elongated element 23 and guide the elongated element 23 to extend to the rear side of the back panel 12 to connect with the adjustable locker 25.

According to the preferred embodiment, there are a plurality of elongated element guiders 26 provided on the two upper side supports 211, 221 and the rear side of the back panel 12, wherein each of the elongated element guiders 26 has a guiding slot 261 for the elongated element 23 slidably passing through, so as to guide the elongated element 23 extended from the back panel 12 through the upper side supports 211, 221 back to the rear side of the back panel 12.

As shown in FIG. 2, there are two pairs of elongated element guiders 26 spacedly affixed to two vertical halves of the rear side of the back panel 12 and another two elongated element guiders 26 affixed to each upper side support 211, 221. Each of the elongated element guiders 26 comprises a section of fabric tape having two sides sewed to the upper side supports 211, 221 or the back panel 12 so as to define the guiding slot 261 between the two sewed sides, so that the elongated element 23 is extended firstly to pass through the two elongated element guiders 26 affixed on the rear side of the back panel 12, secondly to pass through the two elongated element guiders 26 affixed on a front side of the respective upper side support 211, 221, and lastly to pass through another two elongated element guiders 26 affixed on the rear side of the back panel 12. Therefore, the elongated element 23 is evenly supported by the elongated element guiders 26 to extend to a central portion of the rear side of the back panel 12, so that the user can easily operate the adjustable locker 25 to operate and control the length of the holding portion of the elongated element 23 and thus the folding angle of each upper side support 211, 221.

As shown in FIG. 2, the adjustable support system 20 further comprises at least an elongated unit 31 having a predetermined length of holding portion extended from the back panel 12 to the seat panel 11 and an inclination locker 32 securely locked up two free end portions of the elongated unit 31 for adjusting the length of the holding portion of the elongated unit 31, so as to adjust an inclined angle between the back panel 12 and the seat panel 11.

The elongated unit 31, which is embodied as a durable string having a predetermined length, has a controlling portion extended from the back panel 12 through the two side supporting units 21, 22 and two free ends arranged to extend to a front central portion of the seat frame 11 to adjustably engage with the inclination locker 32.

At least a portion the elongated unit 31 can also be affixed to the back frame 12, similar to the elongated element 23, to form two control sections 311, 312 for two halves of the controlling portion of the elongated unit 31 and self-adjusting to fit the folding angles of the two upper side support 211, 221 respectively.

Accordingly, the inclination locker 32 having the same structure of the adjustable locker 25 can securely and firmly lock up two free end portions of the elongated unit 31 so as to adjust the length of the controlling portion of the elongated unit 31 to adjust the inclined angle between the back seat 12 and the seat frame 11.

Figure 5:
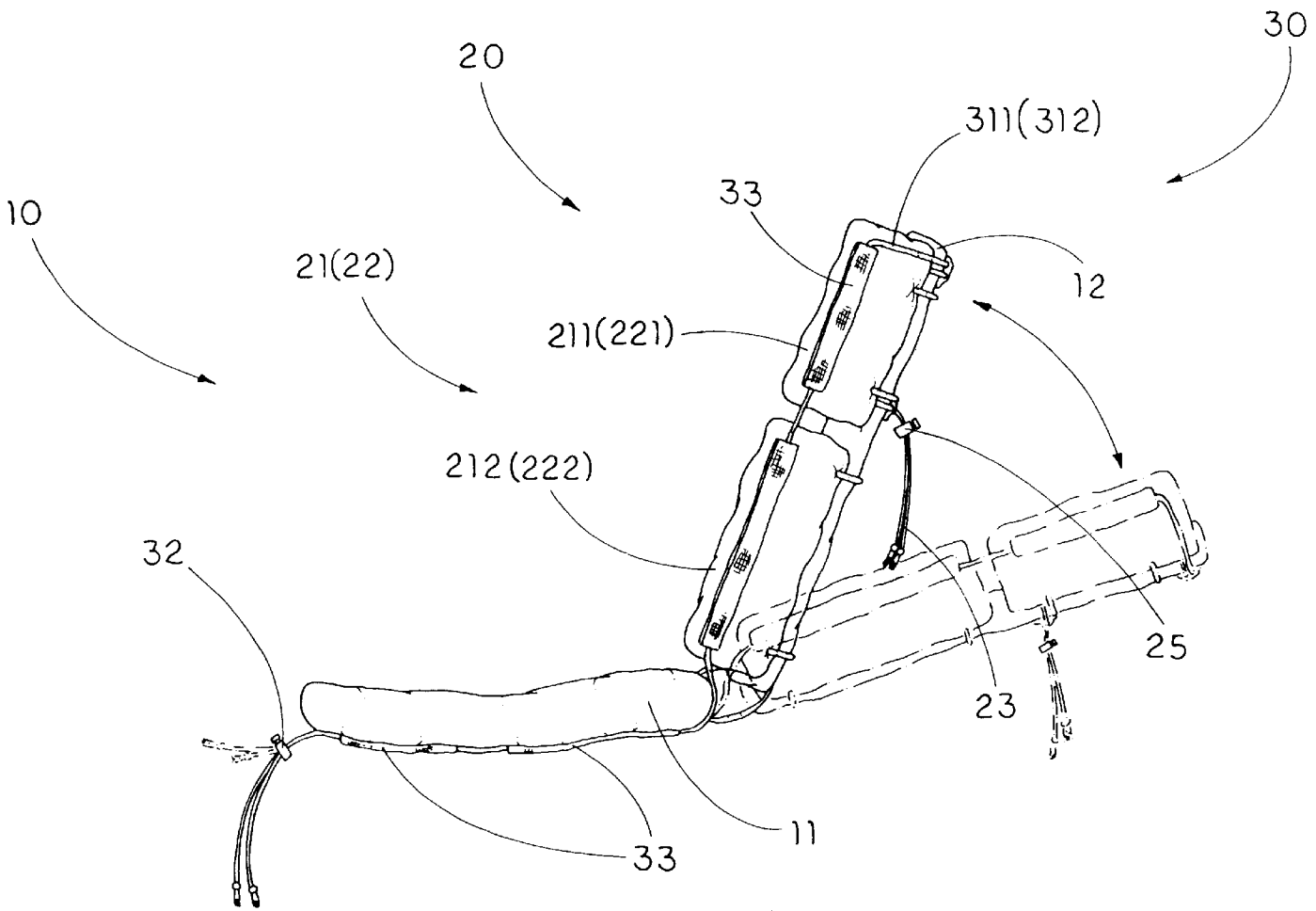
FIG. 5 a sectional view of the adjustable support system according to the above preferred embodiment of the present invention.

Therefore, by adjusting the lock-up position of the inclination locker 32, the user can adjust the length of the controlling portion of the elongated unit 31 extending from the back panel 12 to the seat panel 11. The shorter the length of the controlling portion of the elongated unit 31 between the back panel 12 and the inclination locker 32, the back panel 12 will be set a more upright position. The longer the length of the controlling portion of the elongated unit 31 extending between the back panel 12 and the inclination locker 32, the back panel 12 will be set a more inclined position. It is worth to mention that since the user can lock the inclination locker 32 at any position along the elongated unit 31, the user can adjust the back panel 12 at any desired inclined angle, as shown in FIG. 5.

It is worth to mention that in order to achieve the well support of the seat structure, the user preferably adjust the folding angle of each of the side supporting units 21, 22 and then the inclined angle of the back panel 12. When the folding position of the two upper side support 211, 221 of the side supporting units 21, 22 is locked up by the adjustable locker 25, the length of the holding portion of the elongated element 23 will not be susceptible to be adjusted by varying the length of the controlling potion of the elongated unit 31 to adjust the inclined angle of the back frame 12. Thus, the elongated unit 31 can also adjust two side portions of the seat panel 11 for supporting the user's thigh when he or she sits on seat structure 10.

Moreover, each of the free ends of the elongated unit 31 is firmly tied to form a knot 310 for blocking the elongated unit 31 from sliding out of the inclination locker 32 so as to prevent the inclination locker 32 from being disengaged from the elongated unit 31 accidentally during adjusting the position of the inclination locker 32.

In order to more effectively guide the adjustment of the elongated unit 31, the adjustable support system 20 further comprises at least two pairs of elongated unit guiders 33 provided on two side supporting units 21, 22 and the seat panel 11 respectively wherein the elongated unit 31 is extended to pass through the four elongated unit guiders 33 respectively so as to support the elongated unit 31 and guide the elongated unit 31 to extend from the back panel 12 to the front central portion of the seat panel 11 to connect with the inclination locker 32.

As shown in FIG. 2, there is one elongated unit guider 33 provided on the back panel 12, four elongated unit guiders 33 affixed to the two side supporting units 21, 22 respectively, and four elongated unit guiders 33 spacedly affixed to the seat panel 11, wherein each of the elongated unit guiders 33 has a guiding groove 331 for the elongated unit 32 slidably passing through, so as to guide the elongated unit 32 extended from the back panel 12 to the seat panel 11 through the side supporting units 21, 22.

Each of the elongated unit guiders 33 comprises an elongated fabric tape having two sides sewed to the back panel 12, the two side supporting units 21, 22, or the seat panel 11 so as to define the guiding groove 331 between the two sewed sides so that the elongated unit 31 is extended firstly pass through the elongated unit guider 33 affixed on the rear side of the back panel 12, secondly pass through the two elongated unit guiders 33 affixed on the respective side supporting unit 21, 22, and lastly pass through another two elongated unit guiders 33 affixed on the rear side of the seat panel 11. Therefore, the elongated unit 31 is evenly supported by the elongated unit guiders 33 to extend to a front central portion of the rear side of the seat panel 11, so that the user can easily operate the inclination locker 32 to operate and control the length of the controlling portion of the elongated unit 31 and thus the inclined angle of the back panel 12.

Preferably, the elongated unit guiders 33 on the back panel 12 are cut to form a plurality of sections thereof so as to form the elongated element guiders 26. In other words, the elongated unit 31 is also slidably passing though the guiding slot 261 of the elongated element guider 26, which is the guiding groove 331 of the elongated unit 31, to the seat panel 11.

In view of the above, the seat structure 10 of the present invention can be incorporated with a car seat of a stroller or a vehicle, or even a bassinet to well support the baby, wherein the baby's neck which is soft and weak is supported by the two side supporting units 21, 22 so as to avoid an unwanted neck injury during the movement of the stroller, vehicle, or bassinet.

What is claimed is:

1. A seat structure, comprising:

a seat panel;

a back panel foldably extended from said seat panel; and an adjustable support system, which comprises:

two side supporting units foldably extended from two vertical sides of said back panel, wherein each of said side supporting units comprises an upper side support and a lower side support, wherein said upper side support and said lower side support of each said side supporting unit are foldably extended from said respective vertical side of said back panel respectively for individually adjusting the folding angle with respect to said back panel;

at least an elongated element having a predetermined length of holding portion extended from said back panel through said two side supporting units respectively to a rear side of said back panel; and an adjustable locker which securely locks up two free end portions of said elongated element for adjusting said length of said holding portion of said elongated element, so as to adjust said folding angle between each of said side supporting units and said back panel.

2. A seat structure, as recited in claim 1, wherein said adjustable support system further comprises at least two elongated element guiders provided on said two upper side supports for supporting and guiding said elongated element.

3. A seat structure, as recited in claim 2, wherein each of said elongated element guiders has a guiding slot for said elongated element slidably passing through, so as to guide said elongated element extended to connect with said adjustable locker.

4. A seat structure, as recited in claim 3, wherein said elongated element is a string and each of said elongated element guiders comprises a section of fabric tape having two sides sewed to said upper side support so as to define said guiding slot between said two sides, wherein said elongated element is extended to pass through said guiding slots of said elongated element guiders affixed on said upper side supports respectively.

5. A seat structure, as recited in claim 4, wherein said adjustable locker comprises a locker body having a locker hole for two free end portions of said elongated element to slidably penetrate therethrough, and an operation body arranged to lock up said elongated element on said locker body in such a manner that said adjustable locker is arranged to selectively lock up said elongated element in a predetermined position for adjusting said length of said elongated element so as to adjust said folding angles of said two side supporting units.

6. A seat structure, as recited in claim 5, wherein said locker body is a hollow body having an opened end and a closed end and said locker hole radially passes through a central position of said locker body, wherein said operation body has an inner end slidably inserted into said locker body through said opened end, wherein said adjustable locker further comprises a spring disposed between said closed end of said locker body and said inner end of said operation body, wherein said operation body further has a locking hole radially passing through in such a manner that said locking hole and said locker hole are able to be arranged coaxially overlapped with each other when pushing an outer end of said operation body towards said closed end of said locker body so as to enable said two free end portions of said elongated element to slidably pass through both said locker hole said locking hole, wherein said spring normally pushes said operation body towards the opened end and reduces a gap formed between said locking hole and said locker hole, so that said locker body and said operation body compress said elongated element passing therethrough so as to securely and firmly lock up said position of said adjustable locker with respect to said elongated element.

7. A seat structure, as recited in claim 6, wherein at least a portion of said elongated element is firmly affixed on said back panel to form two holding sections to independently and adjustably control said folding angles of said two upper side supports respectively.

8. A seat structure, as recite in claim 6, wherein said adjustable support system further comprises at least an elongated unit having a predetermined length of a controlling portion extended from said back panel to a front central portion of said seat panel and an inclination locker securely locking up two free end portions of said elongated unit for adjusting said length of said controlling portion of said elongated unit, so as to adjust an inclined angle between said back panel and said seat panel.

9. A seat structure, comprising:

a seat panel;

a back panel foldably extended from said seat panel; and an adjustable support system, which comprises:

two side supporting units foldably extended from two vertical sides of said back panel;

at least an elongated element having a predetermined length of holding portion extended from said back panel through said two side supporting units respectively to a rear side of said back panel; and an adjustable locker which securely locks up two free end portions of said elongated element for adjusting said length of said holding portion of said elongated element, so as to adjust a folding angle between each of said side supporting units and said back panel, wherein said adjustable locker comprises a locker body having a locker hole for two free end portions of said elongated element to slidably penetrate therethrough, and an operation body arranged to lock up said two elongated element on said locker body in such a manner that said adjustable locker is arranged to selectively lock up said elongated element in a predetermined position for adjusting said length of said elongated element so as to adjust the folding angles of said two side supporting units, wherein said locker body is a hollow body having an opened end and a closed end and said locker hole radially passes through a central position of said locker body, wherein said operation body has an inner end slidably inserted into said locker body through said opened end, wherein said adjustable locker further comprises a spring disposed between said closed end of said locker body and said inner end of said operation body, wherein said operation body further has a locking hole radially passing through in such a manner that said locking hole and said locker hole are able to be arranged coaxially overlapped with each other when pushing an outer end of said operation body towards said closed end of said locker body so as to enable said two free end portions of said elongated element to slidably pass through both said locker hole and said locking hole, wherein said spring normally pushes said operation body towards the opened end and reduces a gap formed between said locking hole and said locker hole, so that said locker body and said operation body compress said elongated element passing therethrough so as to securely and firmly lock up said position of said adjustable locker with respect to said elongated element.

10. A seat structure, as recited in claim 9, wherein at least a portion of said elongated element is firmly affixed on said back panel to form two holding sections to independently and adjustably control said folding angles of said two upper side supports respectively.

11. A seat structure, as recite in claim 9, wherein said adjustable support system further comprises at least an elongated unit having a predetermined length of a controlling portion extended from said back panel to a front central portion of said seat panel and an inclination locker securely locking up two free end portions of said elongated unit for adjusting said length of said controlling portion of said elongated unit, so as to adjust an inclined angle between said back panel and said seat panel.

12. A seat structure, comprising:

a seat panel;

a back panel foldably extended from said seat panel; and an adjustable support system, which comprises:

at least an elongated unit having a predetermined length of a controlling portion extended from said back panel to a front central portion of said seat panel;

an inclination locker which securely locks up two free end portions of said elongated unit for adjusting said length of said controlling portion of said elongated unit, so as to adjust an inclined angle between said back panel and said seat panel;

two side supporting units foldably extended from two vertical sides of said back panel wherein said elongated unit is extended from said back panel to said seat panel through said side supporting units;

at least an elongated element having a predetermined length of a holding portion extended from said back panel through said two side supporting units respectively to a rear side of said back panel, and an adjustable locker securely locking up two free end portions of said elongated element for adjusting said length of said holding portion of said elongated element, so as to adjust a folding angle between each of said side supporting units and said back panel; and at least two elongated unit guiders provided on said two side supporting units for supporting and guiding said elongated element.

13. A seat structure, as recited in claim 12, wherein each of said elongated unit guiders has a guiding groove for said elongated unit slidably passing through, so as to guide said elongated unit to extend to connect with said inclination locker.

14. A seat structure, as recited in 13, wherein said adjustable locker, having the same structure of said inclination locker, comprises a locker body having a locker hole for two free end portions of said elongated element to slidably penetrate therethrough, and an operation body arranged to lock up said elongated element on said locker body in such a manner that said adjustable locker is arranged to selectively lock up said elongated element in a predetermined position for adjusting said length of said elongated element so as to adjust said folding angles of said two side supporting units.

15. A seat structure, as recited in claim 14, wherein said locker body is a hollow body having an opened end and a closed end and said locker hole radially passes through a central position of said locker body, wherein said operation body has an inner end slidably inserted into said locker body through said opened end, wherein said adjustable locker further comprises a spring disposed between said closed end of said locker body and said inner end of said operating body, wherein said operation body further has a locking hole radially passing through in such a manner that said locking hole and said locker hole are able to be arranged coaxially overlapped with each other when pushing an outer end of said operation body towards said closed end of said locker body so as to enable two free end positions of said elongated element slidably pass through both said locker hole and said locking hole, wherein said spring normally pushes said operation body towards the opened end and reduces a gap formed between said locking hole and said locker hole, so that said locker body and said operation body compress said elongated element passing therethrough so as to securely and firmly lock up said position of said adjustable locker with respect to said elongated element.

* * * * *